US009926757B2

(12) United States Patent
Attiwell

(10) Patent No.: US 9,926,757 B2
(45) Date of Patent: Mar. 27, 2018

(54) HEAD ASSEMBLY AND A VALVE SYSTEM FOR USE IN A CORE DRILLING SYSTEM

(71) Applicant: Swick Mining Services Ltd., South Guildford (AU)

(72) Inventor: Paul Attiwell, Mullaloo (AU)

(73) Assignee: Swick Mining Services Ltd, South Guildford (AU)

( * ) Notice: Subject to any disclaimer, the term of this patent is extended or adjusted under 35 U.S.C. 154(b) by 285 days.

(21) Appl. No.: 14/896,077

(22) PCT Filed: May 30, 2014

(86) PCT No.: PCT/AU2014/000569

§ 371 (c)(1),
(2) Date: Dec. 4, 2015

(87) PCT Pub. No.: WO2014/194353

PCT Pub. Date: Dec. 11, 2014

(65) Prior Publication Data

US 2016/0123101 A1 May 5, 2016

(30) Foreign Application Priority Data

Jun. 6, 2013 (AU) ..... 2013902051

(51) Int. Cl.
*E21B 25/02* (2006.01)
*E21B 23/10* (2006.01)
*E21B 21/10* (2006.01)

(52) U.S. Cl.
CPC ..... *E21B 25/02* (2013.01); *E21B 21/10* (2013.01); *E21B 23/10* (2013.01)

(58) Field of Classification Search
CPC ..... E21B 25/02; E21B 23/10
See application file for complete search history.

(56) References Cited

U.S. PATENT DOCUMENTS 2,277,989 A * 3/1942 Kinnear ..... E21B 10/32 166/383
5,020,612 A 6/1991 Williams
(Continued)

FOREIGN PATENT DOCUMENTS

DE 0152602 A 12/1981 ..... E21B 25/02

OTHER PUBLICATIONS

Australian Patent Office, Second Written Opinion of the International Preliminary Examining Authority, dated Apr. 9, 2015, PCT/AU2014/000569, together with the Written Opinion of the International Searching Authority, 5 pages.
(Continued)

*Primary Examiner* — Kipp C Wallace
(74) *Attorney, Agent, or Firm* — Sunstein Kann Murphy & Timbers LLP

(57) ABSTRACT

A valve system for an inner tube assembly is described. The inner tube assembly is arranged to be used in a drilling system to retrieve a core sample, and is arranged to be insertable into a drill string of the drilling system at a first end of the drill string. The valve system is arranged to be configurable in a first closed configuration, an open configuration, and a second closed configuration. The valve system moves to the first closed configuration when fluid is pumped along an interior region of the drill string towards the inner tube assembly in a direction from the first end of the drill string to the inner tube assembly. The valve system is arranged such that, when in the first closed configuration, a pressure of the fluid increases to facilitate deploying the inner tube assembly towards a second end of the drill string. The valve system moves to the open configuration in response to the inner tube assembly reaching a vicinity of the second end of the drill string and being prevented from moving further towards the second end of the drill string.
(Continued)

The valve system is arranged such that, when in the open configuration, fluid can flow to a drill bit located at or near the second end of the drill string. The valve system moves to the second closed configuration when fluid is pumped along the interior region of the drill string towards the inner tube assembly in a direction from the second end of the drill string to the inner tube assembly. The valve system is arranged such that, when in the second closed configuration, the pressure of the fluid increases to facilitate retrieving the inner tube assembly from the vicinity of the second end of the drill string.

19 Claims, 13 Drawing Sheets

(56) References Cited

U.S. PATENT DOCUMENTS

| | | | | |
|---|---|---|---|---|
| 5,934,393 | A * | 8/1999 | Marshall | E21B 25/02 175/236 |
| 6,029,758 | A | 2/2000 | Novacovicci et al. | 175/234 |
| 6,425,449 | B1 * | 7/2002 | Marshall | E21B 23/08 175/236 |

OTHER PUBLICATIONS

European Patent Office, Extended European Search Report, Application No. 14807243.2, 6 pages, dated Feb. 1, 2017.

* cited by examiner

HEAD ASSEMBLY AND A VALVE SYSTEM FOR USE IN A CORE DRILLING SYSTEM

FIELD OF THE INVENTION

The present invention relates to a head assembly and a valve system for use in a core drilling system.

BACKGROUND OF THE INVENTION

Referring to FIGS. 1*a* to 1*c*, there is shown a conventional method of retrieving a core sample 10 created by a core drilling system 12. In this example, the drilling system 12 is drilling downwards in a substantially vertical orientation, although it will be appreciated that drilling may be performed in any appropriate orientation, for example at any angle between +35° to −90° with respect to a horizontal plane.

The core sample 10 is created when an annular drill bit 14 drills through ground 16. The drill bit 14 is coupled to a lower end of an outer tube assembly 18, which in turn is arranged at a lower end of a drill string 20 which extends to a collar point of the drilling system 12. In this example, the ground 16 is at a bottom of a borehole 22 that has been drilled by the core drilling system 12.

An inner tube assembly 24 is typically used to retrieve the core sample 10. The inner tube assembly 24 is deployed down (FIG. 1*a*) the drill string 20. The inner tube assembly 24 engages with the outer tube assembly 18 (FIG. 1*b*) and the core sample 10 is then created by drilling through the ground 16 (FIG. 1*c*). The inner tube assembly 24 retains the core sample 10 when the core sample 10 is created and, after the core sample 10 is broken off from the ground 16, the inner tube assembly 24 is retrieved from down the drill string 20.

Typically, the inner tube assembly 24 comprises a core tube assembly 26 that is arranged to retain the core sample 10, and a head assembly 28 that is arranged to facilitate deploying the inner tube assembly 24 down the drill string 20, and that is further arranged to facilitate retrieving the inner tube assembly 24 from down the drill string 20. To achieve this, the head assembly 28 is arranged such that it can be coupled to the core tube assembly 26 and sent down the drill string 20, for example by pumping water down the drill string 20 towards the inner tube assembly 24, or by dropping the inner tube assembly 24 down the drill string 20 if the drill string is in a substantially vertical orientation. Once the inner tube assembly 24 has been deployed down the drill string 20, the head assembly 28 engages with the outer tube assembly 18 and drilling can then commence. After the drilling has created the core sample 10 and the core sample 10 is retained in the core tube assembly 26, an overshot 30, which is coupled via a wireline 32 to a winch (not shown) located at the collar point, is deployed along the drill string 20 to engage with the head assembly 28. The overshot 30 is then winched to the collar point, bringing the inner tube assembly 24 and the core sample 10 to the collar point for retrieval.

The retrieval of core samples is a limiting factor in the time taken to perform core drilling, and the time taken to retrieve the core samples increases as the drilling depth increases.

SUMMARY OF THE INVENTION

In accordance with a first aspect of the present invention, there is provided a valve system for an inner tube assembly arranged to be used in a drilling system to retrieve a core sample created by the drilling system, the inner tube assembly being arranged to be insertable into a drill string of the drilling system at a first end of the drill string, the valve system being arranged to be configurable in a first closed configuration, an open configuration, and a second closed configuration, wherein:

the valve system moves to the first closed configuration when fluid is pumped along an interior region of the drill string towards the inner tube assembly in a direction from the first end of the drill string to the inner tube assembly, the valve system being arranged such that, when in the first closed configuration, a pressure of the fluid increases to facilitate deploying the inner tube assembly towards a second end of the drill string;

the valve system moves to the open configuration in response to the inner tube assembly reaching a vicinity of the second end of the drill string and being prevented from moving further towards the second end of the drill string, the valve system being arranged such that, when in the open configuration, fluid can flow to a drill bit located at or near the second end of the drill string; and the valve system moves to the second closed configuration when fluid is pumped along the interior region of the drill string towards the inner tube assembly in a direction from the second end of the drill string to the inner tube assembly, the valve system being arranged such that, when in the second closed configuration, the pressure of the fluid increases to facilitate retrieving the inner tube assembly from the vicinity of the second end of the drill string.

It will be appreciated that the first and second closed configurations may be substantially similar configurations, or they may be different configurations.

The valve system may comprise a valve member and a valve seat with which the valve member can form a seal, the valve system being arranged such that the valve member is urged towards the valve seat into the first closed configuration to form a seal with the valve seat when fluid flows along the interior region of the drill string towards the inner tube assembly in a direction from the first end of the drill string to the inner tube assembly. The seal formed between the valve member and the valve seat may be such that sufficient fluid pressure can build behind the valve system to deploy the inner tube assembly towards the second end of the drill string.

The valve member and the valve seat may be arranged such that the valve member can be pushed through the valve seat to move the valve system into the open configuration in response to sufficient fluid pressure, such as that caused when the inner tube assembly seats with an outer tube assembly of the drilling system and the inner tube assembly is unable to move further towards the second end of the drill string, acting on the valve member.

The valve member and the valve seat may be arranged such that when the valve system is in the open configuration the valve member is urged to move towards the valve seat and thereby the valve system to move to the second closed configuration to form a seal with the valve seat when fluid flows along the interior region of the drill string towards the inner tube assembly in a direction from the second end of the drill string to the inner tube assembly. The seal formed between the valve member and the valve seat may be such that sufficient fluid pressure can build behind the valve system to retrieve the inner tube assembly from the vicinity of the second end of the drill string, and/or to disengage the inner tube assembly from the drill string.

In one embodiment, the valve system is arranged such that the valve member is prevented from being pushed through the valve seat when the valve system is in the second closed configuration when fluid is flowing along the interior region of the drill string towards the inner tube assembly in a direction from the second end of the drill string to the inner tube assembly.

The valve system may comprise a head portion to which the valve member is coupled, the head portion being arranged to be retained in a position such that the valve member is prevented from being pushed through the valve seat when the valve system is in the second closed configuration and when fluid is flowing along the interior region of the drill string towards the inner tube assembly in a direction from the second end of the drill string to the inner tube assembly.

The valve system may comprise a stop, the valve system being arranged such that the head portion can move relative to the stop, the head portion comprising a recess that is arranged to engage with the stop when the valve system moves to the second closed configuration so as to retain the head portion, thereby preventing the valve member from being pushed through the valve seat.

In one embodiment, the stop comprises a dowel and the recess of the head portion is arranged to receive at least a portion of the dowel. The head portion may comprise a helical groove that is arranged to receive at least a portion of the dowel such that the head portion rotates and moves in a direction towards the second end of the drill string relative to the dowel as the valve system moves to the first closed configuration, the recess being connected to the helical groove and being arranged such that the at least a portion of the dowel is received in the recess when the valve system moves from the open configuration to the second closed configuration.

The valve member may be coupled to the head portion via a stem portion, the stem portion having a length that positions the valve member relative to the valve seat.

The valve member may have a substantially circular cross section, and the valve seat may have a correspondingly shaped cross section. In one embodiment, the valve member is at least partially spherical shaped and the valve seat is a bushing.

The valve system may comprise at least one upper and at least one lower valve aperture for directing fluid flow to the valve member. At least one of the upper or lower valve apertures may be arranged so as to direct fluid flowing therethrough directly onto the valve member.

The valve system may comprise a seal that is arranged on an exterior surface of the inner tube assembly at a location between the upper and lower valve apertures, the seal being arranged to form a seal between the exterior surface of the inner tube assembly and an interior surface of the drill string so as to prevent fluid flowing around the exterior of the inner tube assembly between regions in the vicinity of the upper and lower apertures.

In accordance with a second aspect of the present invention, there is provided a head assembly for deploying a core tube assembly in a drill string and for retrieving the core tube assembly from the drill string, the head assembly being arranged to be couplable to the core tube assembly to form an inner tube assembly, the head assembly comprising a valve system in accordance with the first aspect of the present invention.

In accordance with a third aspect of the present invention, there is provided a component of a head assembly for deploying a core tube assembly in a drill string and for retrieving the core tube assembly from the drill string, the head assembly being arranged to be couplable to the core tube assembly to form an inner tube assembly, the component of the head assembly comprising a valve system in accordance with the first aspect of the present invention. The component of the head assembly may be, for example, a valve and spearhead assembly.

In accordance with a fourth aspect of the present invention, there is provided a method of deploying an inner tube assembly in a drill string of a drilling system, and of retrieving the inner tube assembly from the drill string, the inner tube assembly being arranged to be insertable into the drill string at a first end of the drill string, the inner tube assembly comprising a valve system that is arranged so as to be configurable into a first closed configuration, an open configuration, and a second closed configuration, the method comprising the steps of:

- pumping fluid along an interior region of the drill string, in which the inner tube assembly is arranged, towards the inner tube assembly in a direction from the first end of the drill string to the inner tube assembly;
- moving the valve system to the first closed configuration to facilitate deploying the inner tube assembly towards a second end of the drill string in response to the fluid flowing along the interior region of the drill string towards the inner tube assembly in a direction from the first end of the drill string to the inner tube assembly;
- moving the valve system to the open configuration in response to the inner tube assembly reaching a vicinity of the second end of the drill string and being prevented from moving further towards the second end of the drill string, the valve system being arranged such that, when in the open configuration, fluid can flow to a drill bit located at or near the second end of the drill string;
- pumping fluid along the interior region of the drill string towards the inner tube assembly in a direction from the second end of the drill string to the inner tube assembly; and
- moving the valve system to the second closed configuration to facilitate retrieving the head assembly from the vicinity of the second end of the drill string in response to the fluid flowing along the interior region of the drill string towards the inner tube assembly in a direction from the second end of the drill string to the inner tube assembly.

It will be appreciated that the first and second closed configurations may be substantially similar configurations, or they may be different configurations.

The valve system may comprise a valve member and a valve seat with which the valve member can form a seal, and the step of moving the valve system to the first closed configuration may comprise urging the valve member towards the valve seat into the first closed configuration to form a seal with the valve seat in response to the step of pumping fluid along the interior region of the drill string towards the inner tube assembly in a direction from the first end of the drill string to the inner tube assembly. The seal formed between the valve member and the valve seat may be such that sufficient fluid pressure can build behind the valve system to deploy the inner tube assembly towards the second end of the drill string.

The step of moving the valve system to the open configuration may comprise pushing the valve member through the valve seat in response to sufficient fluid pressure, such as that caused when the inner tube assembly seats with an outer tube assembly of the drilling system and the inner tube assembly is unable to move further towards the second end of the drill string, acting on the valve member.

The step of moving the valve system to the second closed configuration may comprise urging the valve member towards the valve seat and thereby the valve system to move to the second closed configuration to form a seal with the valve seat in response to the step of pumping fluid along the interior region of the drill string towards the inner tube assembly in a direction from the second end of the drill string to the inner tube assembly. The seal formed between the valve member and the valve seat may be such that sufficient fluid pressure can build behind the valve system to retrieve the inner tube assembly from the vicinity of the second end of the drill string, and/or to disengage the inner tube assembly from the drill string.

In one embodiment, the method comprises the step of preventing the valve member from being pushed through the valve seat after the step of moving the valve system to the second closed configuration when fluid is flowing along the interior region of the drill string towards the inner tube assembly in a direction from the second end of the drill string to the inner tube assembly.

The valve system may comprise a head portion to which the valve member is coupled, and the method may comprise a step of retaining the head portion in a position such that the valve member is prevented from being pushed through the valve seat after the step of moving the valve system to the second closed configuration and when fluid is flowing along the interior region of the drill string towards the inner tube assembly in a direction from the second end of the drill string to the inner tube assembly.

The valve system may comprise a stop and the head portion may comprise a recess, the method comprising the step of moving the head portion relative to the stop such that the recess of the head portion engages with the stop in response to the step of moving the valve system to the second closed configuration.

In one embodiment, the stop comprises a dowel and the head portion comprises a helical groove that is arranged to receive at least a portion of the dowel, the method comprising the step of rotating the head portion and moving the head portion in a direction towards the second end of the drill string as the valve system moves to the first closed configuration.

The valve system may comprise at least one upper and at least one lower valve aperture, and the method may comprise directing fluid flow to the valve member. In one embodiment, fluid flowing through the at least one upper and at least one lower valve apertures is directed so as to flow directly onto the valve member.

The method may comprise sealing between an exterior surface of the inner tube assembly and an interior surface of the drill string at a location of the exterior surface of the inner tube assembly that is between the upper and lower valve apertures, the seal being formed so as to prevent fluid flowing around the exterior of the inner tube assembly between regions in the vicinity of the upper and lower apertures.

BRIEF DESCRIPTION OF THE FIGURES

Embodiments of the present invention will now be described, by way of example only, with reference to the accompanying figures, in which.

DETAILED DESCRIPTION

Figures 1A, 1B, 1C:
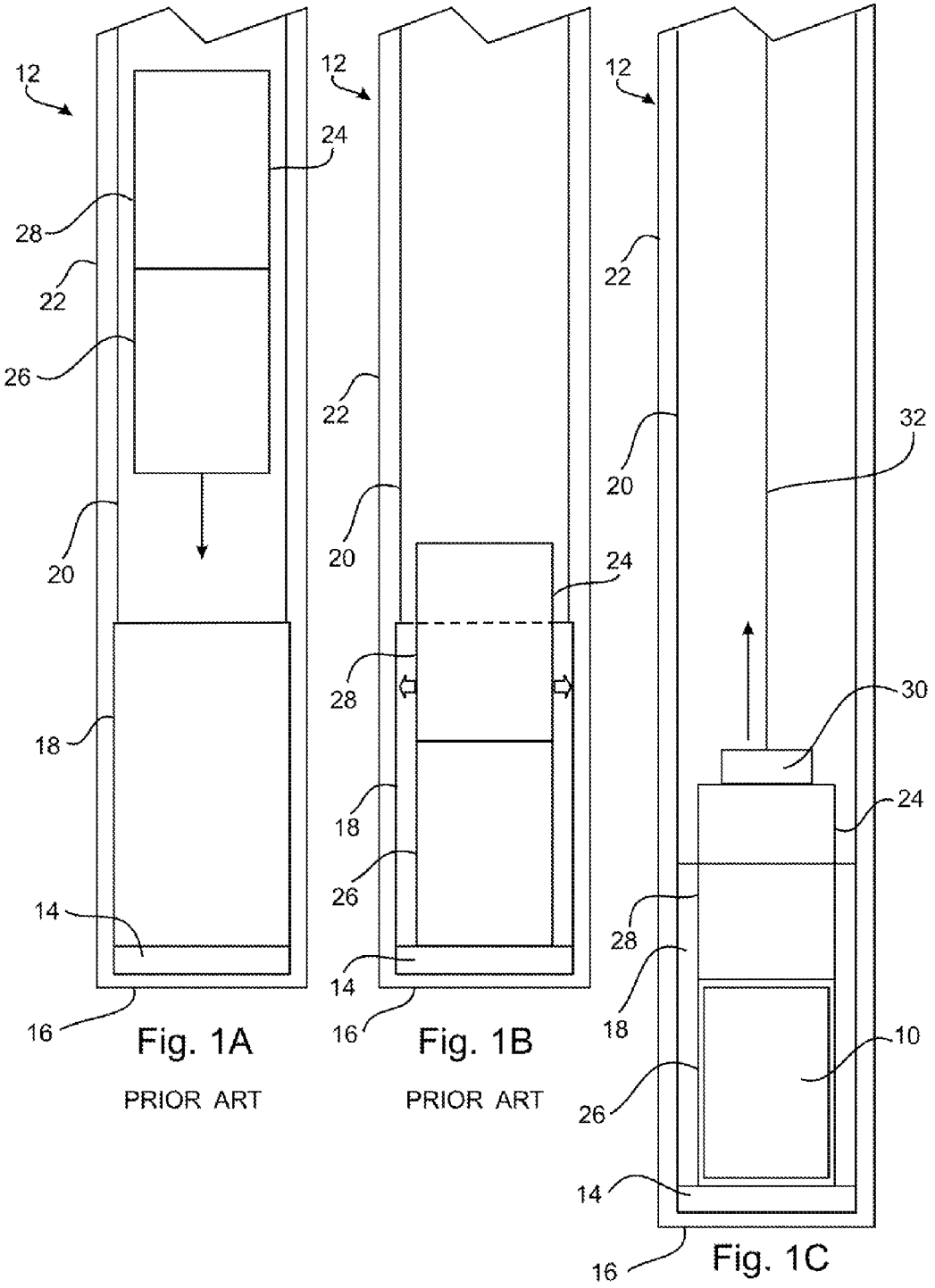
Fig. 1A PRIOR ART
Fig. 1B PRIOR ART
Fig. 1C PRIOR ART
FIGS. 1*a* to 1*c* are functional representations of elements of a conventional core drilling system used to retrieve a core sample created by the drilling system.
Figure 2:
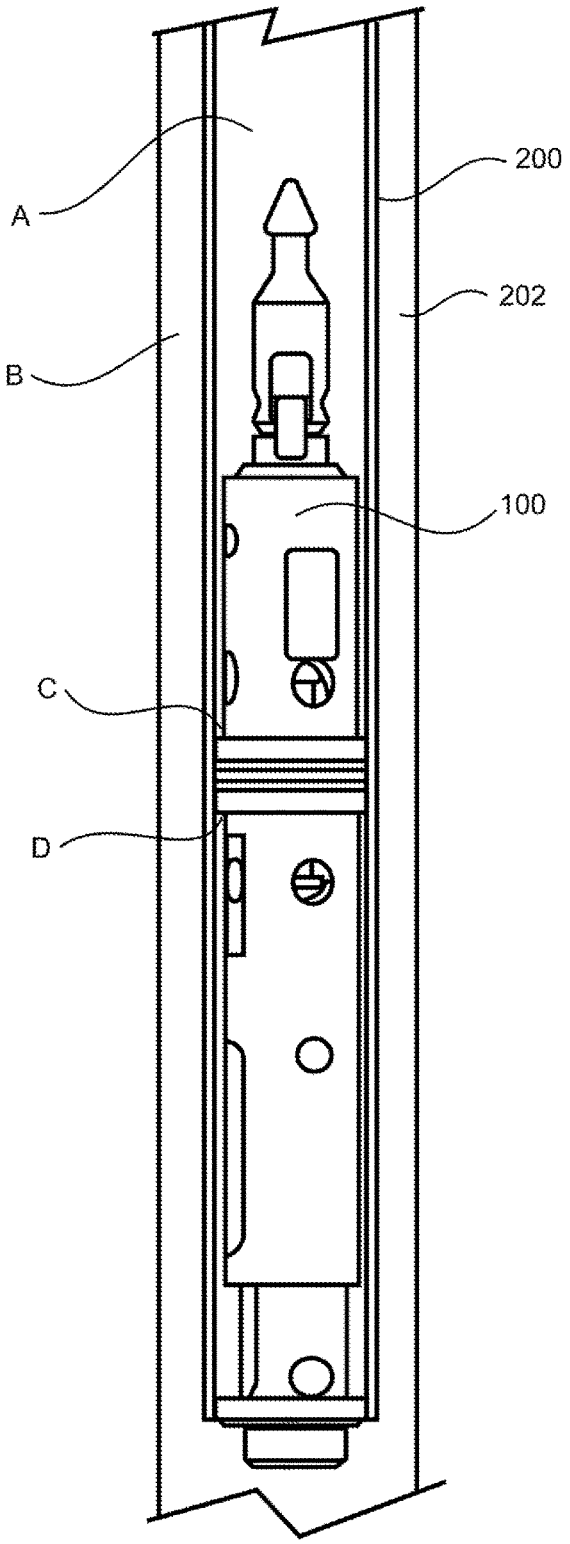
FIG. 2 is a front elevation of a portion of a core drilling system including a head assembly, the head assembly being in accordance with an embodiment of the present invention.

Referring to FIG. 2, there is shown a head assembly 100 that is arranged to facilitate deploying an inner tube assembly 24 down a drill string 200 arranged within a bore hole 202, and that is further arranged to facilitate retrieving the inner tube assembly 24 from the drill string 200.

In this example, the drill string 200 is in a substantially vertical orientation and drilling is being performed vertically downwards. It will, however, be appreciated that drilling may be performed in any appropriate orientation, for example at an angle between +35° to −90° with respect to a horizontal plane. As such, although the operation of the head assembly 100 is described with respect to drilling vertically downwards, the head assembly 100 can operate in any appropriately orientated drill string 200.

The inner tube assembly 24 comprises a core tube assembly 26 for retaining a core sample 10 that has been created by the drill string 200 when drilling the bore hole 202, and the head assembly 100 that facilitates deployment and retrieval of the inner tube assembly 24.

The core tube assembly 26 will typically comprise components that can be used to collect a core sample which may include: an inner tube for housing the core sample 10 as the core sample 10 is drilled; a core lifter for retaining the core sample 10 in the inner tube after the core sample 10 has been broken off after being drilled; a core lifter case for coupling to the inner tube and for housing the core lifter; and a stop ring for retaining the core lifter in the core lifer case.

The head assembly 100 comprises a valve system that is arranged such that the inner tube assembly 24 can be deployed down the drill string 200 when water, or another appropriate fluid, is pumped downwards through an interior region A of the drill string 200 towards the inner tube assembly 24. The valve system is also arranged such that the inner tube assembly 24 can be retrieved from down the drill string 200 when water is pumped up through region A of the drill string 200 towards the inner tube assembly 24. Pumping water up through region A towards the inner tube assembly 24 can be achieved by pumping water downwards through a region B defined between an exterior of the drill string 200 and an interior of the borehole 202. The water is then directed upwards through region A after reaching the bottom of the borehole 202.

Due to the arrangement of the valve system of the head assembly 100, the inner tube assembly 24 can be deployed down, and retrieved from, the drill string 200 by changing the direction of fluid flow through region A of the drill string 200.

The head assembly 100 is shown in more detail in FIGS. 3 to 6. The head assembly 100 comprises a rotatable head portion 102 having a helical groove 104. The rotatable head portion 102 is moveably coupled to an upper retracting case 106 via a dowel 108 that is inserted through the helical groove 104 and a pair of opposing dowel holes 110 of the upper retracting case 106. The rotatable head portion 102 is also coupled to a spearhead 112 that is arranged to engage with an overshot 30 to facilitate conventional wireline retrieval of the head assembly 100 from down the drill string 200 if required.

The upper retracting case 106 comprises a plurality of upper valve apertures 114. The upper valve apertures are a component of the valve system of the head assembly 100.

The head assembly 100 also comprises an indicator piston 116 which is coupled to the head portion 102 such that the indicator piston 116 and the head portion 102 move together.

The indicator piston 116 comprises a ball head 118 that is receivable in a bushing 120, the bushing 120 being arranged such that the ball head 118 seals against the bushing 120 when the ball head 118 moves towards the bushing 120 and, if sufficient force is applied to the indicator piston 116, allows the ball head 118 to pass through the bushing 120. The head portion 102, dowel 108, indicator piston 116, ball head 118, and bushing 120 are additional components of the valve system of the head assembly 100.

The head assembly 100 also comprises a lower retracting case 122 that is coupled to the upper retracting case 106. The lower retracting case 122 is arranged to receive and house a latch assembly 124 for releasably engaging the head assembly 100 to an outer tube assembly 18 that is located at a lower end of the drill string 200. The outer tube assembly 18 will typically comprise components that can be used to house the inner tube assembly 24 and to facilitate drilling the bore hole 202 to obtain the core sample 10. In this example the outer tube assembly 18 comprises: a locking coupling for coupling the outer tube assembly 18 to the drill string 200; an outer tube for housing the inner tube assembly 24 and that couples at a lower end thereof to a drill bit 14; and an adapter coupling that is arranged and coupled between the locking coupling and the outer tube and that provides a region into which latches of the latch assembly 124 can deploy so as to engage the inner tube assembly 24 with the outer tube assembly 18.

The lower retracting case 122 also comprises lower valve apertures 126. The lower valve apertures 126 are additional components of the valve system of the head assembly 100.

The head assembly 100 further comprises a seal 128. When the upper and lower retracting cases 106, 122 are coupled to one another, the seal 128 is arranged around the coupling between the upper and lower retracting cases 106, 122 so as to provide a seal for preventing fluid flowing between regions C and D (see FIG. 2). This arrangement assists in directing fluid that is flowing through region A through an interior of the head assembly 100, rather than around an exterior of the head assembly 100. The seal 128 is particularly located between the upper and lower valve apertures 114, 126 so as to assist in directing fluid flow through the valve apertures 114, 126, and forms a further component of the valve system of the head assembly 100.

In use, the head assembly 100 is coupled to the core tube assembly 26 to form the inner tube assembly 24 and is inserted into the drill string 200. A pump is coupled to the drill string 200 and the pump is configured to pump water downwards through region A of the drill string 200. In response to fluid flowing downwards through region A towards the inner tube assembly 24, the valve system of the head assembly 100 moves to a first closed configuration, preventing the fluid flowing through, or past, the inner tube assembly 24. Fluid pressure therefore increases, forcing the tube assembly 24 to move down the drill string 200 towards the outer tube assembly 18 at the lower end of the drill string 200. It will be appreciated that the pump can be coupled to the drill string 200 in any appropriate way, for example by a series of hoses. It will also be appreciated that, as the drill string 200 is in a substantially vertical orientation in this particular example, the inner tube assembly 24 may be dropped down the drill string 200 and moved down the drill string 200 under the action of gravity rather than being moved down the drill string 200 as the result of pumping water down the drill string 200.

When the inner tube assembly 24 engages with the outer tube assembly 18, the valve system moves to an open configuration to allow fluid to flow through the head assembly 100 to the drill bit 14, thereby assisting with drilling. The process of deploying the head assembly 100 down the drill string 200 will now be described in more detail with reference to FIGS. 7*a* to 7*e*.

Figure 7A:
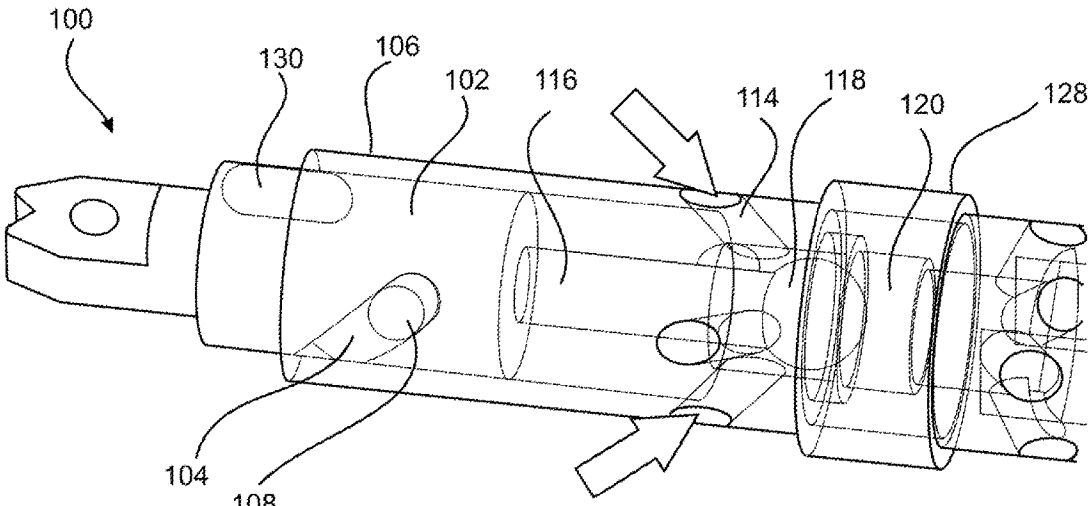
FIGS. 7*a* to 7*e* are views showing a sequence of movements of portions of the head assembly of FIG. 2 during a deployment operation of the head assembly down a drill string.
Figure 7B:
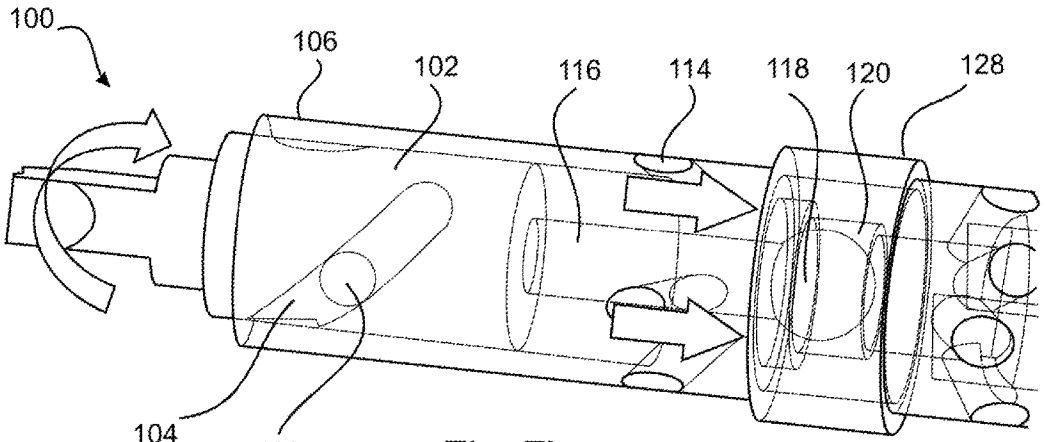

FIG. 7*a* shows the initial stage when water is first pumped downwards through the drill string 200 towards the inner tube assembly 24. As shown by the arrows, the water is directed through the upper valve apertures 114, an action that is assisted by the presence of the seal 128 preventing water flowing around the outside of the head assembly 100. The upper valve apertures 114 are angled towards a location of the ball head 118 such that the water is directed towards the ball head 118. The force of the water on the ball head 118 causes the indicator piston 116 to move downwards, in turn causing the head portion 102 to move downwards and to rotate due to interaction between the helical groove 104 and the dowel 108 as shown in FIG. 7*b*.

Figure 7C:
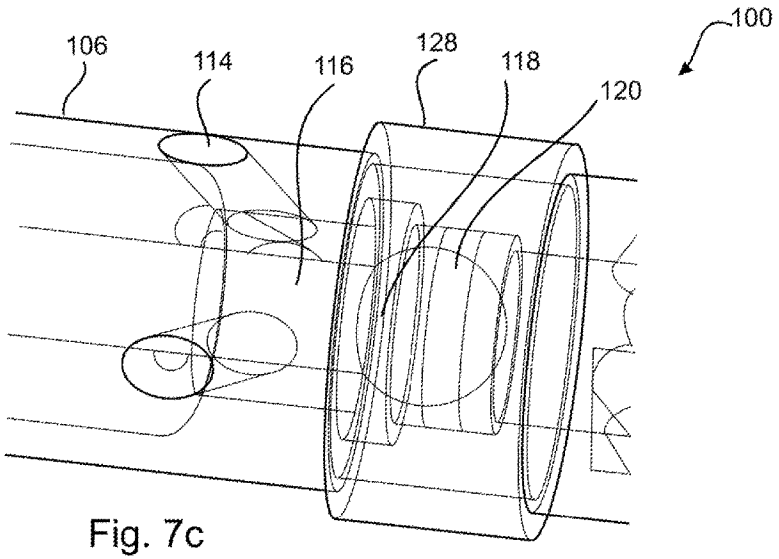

The ball head 118 will continue to move downwards towards the bushing 120 until, as shown in FIG. 7*c*, the ball head 118 forms a seal with the bushing 120. This configuration corresponds to the first closed configuration. The seal between the ball head 118 and the bushing 120 prevents water flowing through the interior of the head assembly 100, and the seal 128 prevents water flowing around the outside of the head assembly 100. As such, water pressure behind the inner tube assembly 24 increases, forcing the inner tube assembly 24 down the drill string 200.

Figure 7D:
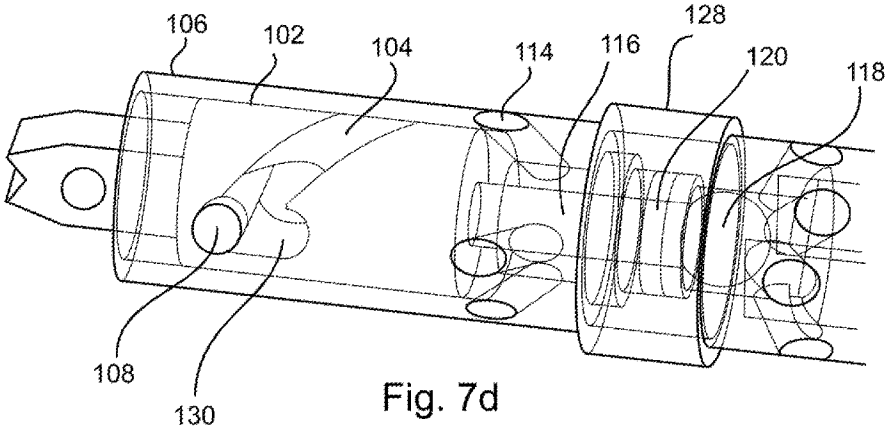
Figure 7E:
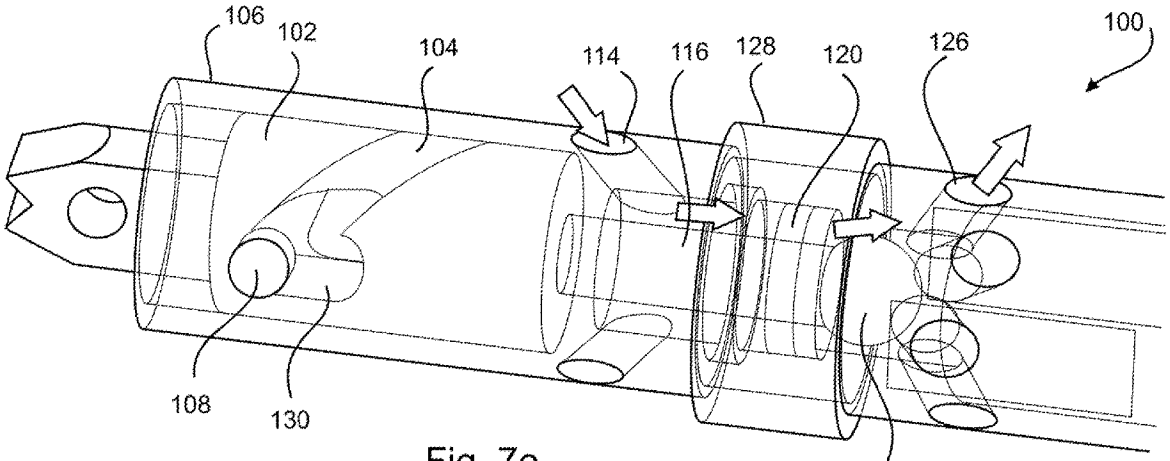

Eventually, the inner tube assembly 24 will reach the outer tube assembly 18 and, when a landing ring of the inner tube assembly 24 impacts on a landing shoulder of the outer tube assembly 18, the inner tube assembly 24 will be prevented from moving further down the drill string 200. At this point, the inner tube assembly 24 cannot move further downwards and so, as shown in FIG. 7*d*, the water pressure will increase until the ball head 118 of the indicator piston 116 is forced through the bushing 120. This causes the valve system to move to the open configuration in which water can flow through the head assembly 100 to the drill bit 14 as shown in FIG. 7*e*. Additionally, the change in down hole water pressure caused by the ball head 118 being forced through the bushing 120 will provide an indication to an operator that the inner tube assembly 24 has seated with the outer tube assembly 18. In this example, the indication is provided by a change in pressure reading that is measured by appropriate pressure sensing equipment. The pressure reading informs the operator that drilling can now commence.

After drilling has been completed and the core tube assembly 26 has obtained a core sample 10, the inner tube assembly 24 can be retrieved from down the drill string 200.

The pump, or a further device such as a pinch valve that is operatively coupled to the pump, is configured to pump water downwards through region B, between the exterior of the drill string 200 and the interior of the bore hole 202, which then reaches the bottom of the bore hole 202 and is directed up through region A of the drill string 200 towards the inner tube assembly 24. In response to fluid flowing up through region A towards the inner tube assembly 24, the valve system of the head assembly 100 moves to a second closed configuration, preventing the fluid flowing through, or past, the inner tube assembly 24. Fluid pressure therefore increases, forcing the tube assembly 24 to move up the drill string 200 towards the upper end of the drill string 200 for retrieval. The process of retrieving the inner tube assembly 24 from down the drill string 200 will now be described in more detail with reference to FIGS. 8*a* to 8*d*.

Figure 8A:
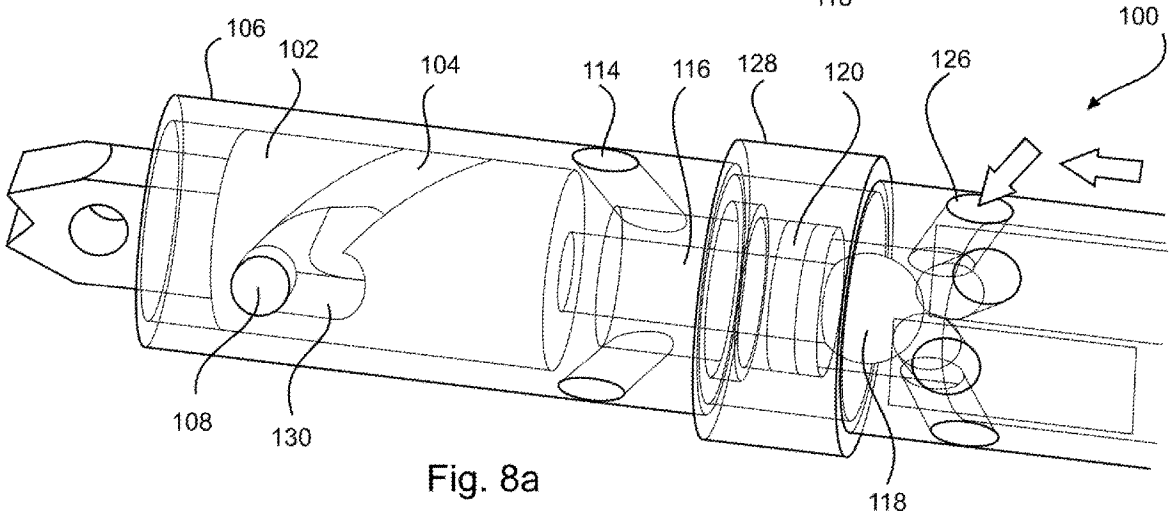
FIGS. 8*a* to 8*d* are views showing a sequence of movements of portions of the head assembly of FIG. 2 during a retrieval operation of the head assembly from down a drill string.
Figure 8B:
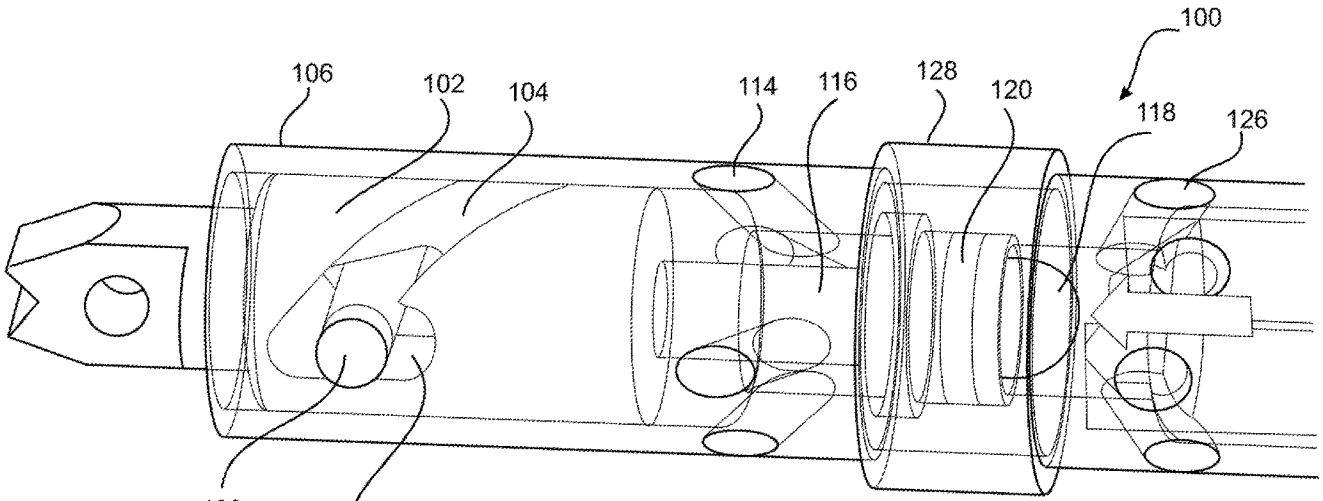
Figure 8C:
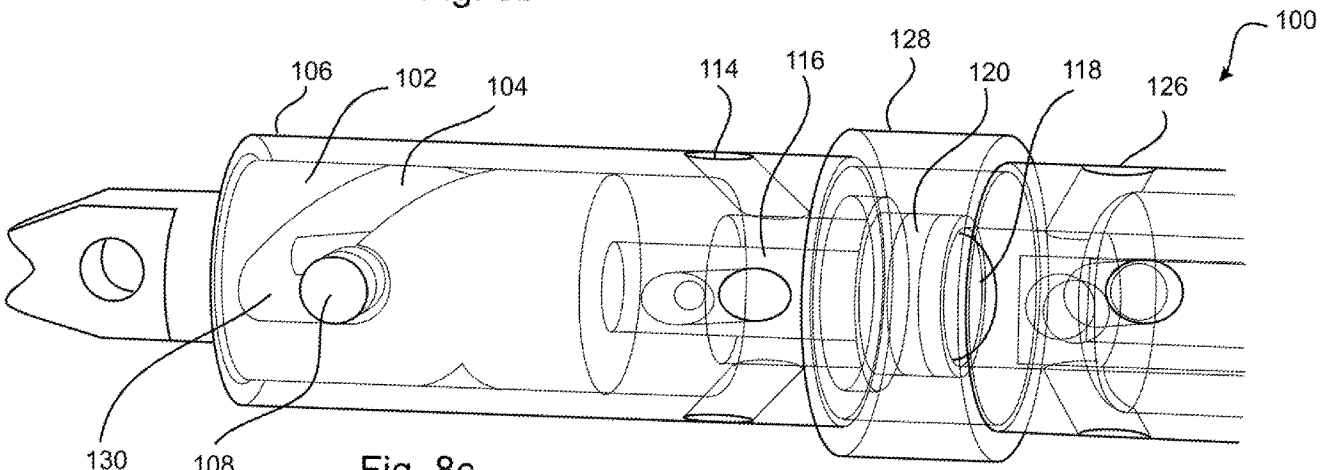
Figure 8D:
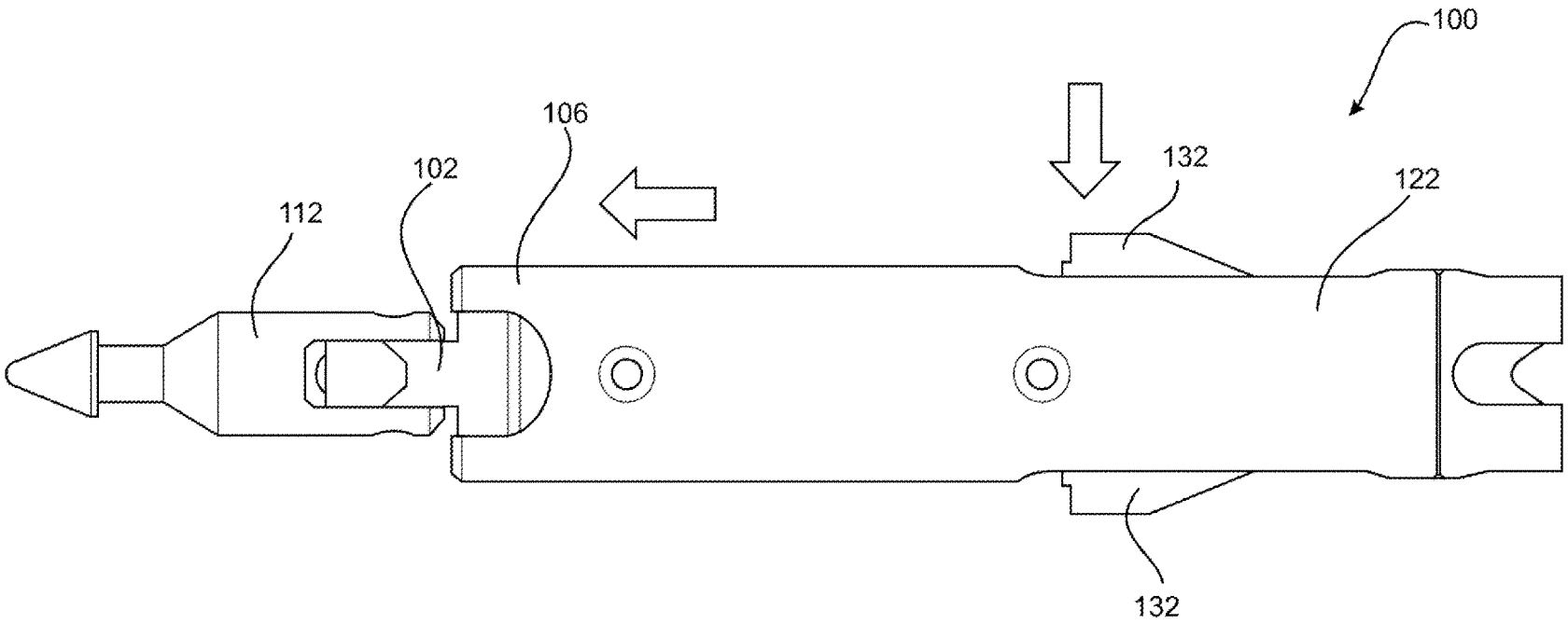

FIG. 8*a* shows the initial stage when water is first pumped upwards through the drill string 200 towards the inner tube assembly 24. As shown by the arrows, the water is directed through the lower valve apertures 126, an action that is assisted by the presence of the seal 128 preventing water flowing around the outside of the head assembly 100. The lower valve apertures 126 are angled towards the location of the ball head 118 such that the water is directed towards the ball head 118. The ball head 118, which was previously forced through the bushing 120, is urged upwards by the water, causing the indicator piston 116 and therefore the head portion 102 to move upwards as shown in FIG. 8*b*. As the head portion 102 moves upwards, a slot 130 of the helical groove 104 engages with the dowel 108, preventing the head portion 102 from moving further upwards. This in turn prevents the ball head 118 from being pushed upwards through the bushing 120. This configuration, corresponding to the second closed configuration, is shown in FIG. 8*c*.

With the valve system in the second closed configuration, the seal between the ball head 118 and the bushing 120 prevents water flowing through the interior of the head assembly 100, and the seal 128 prevents water flowing around the outside of the head assembly 100. As such, water pressure builds behind the head assembly 100, causing the head assembly 100 to move upwards. This in turn urges the lower and upper retracting cases 122, 106 upwards, thereby causing latches 132 of the latch assembly 124 to move inwards (see FIG. 8*d*), disengaging the head assembly 100, and therefore the inner tube assembly 24, from the outer tube assembly 18. With the inner tube assembly 24 disengaged from the drill string 200, the water pressure continues to push the inner tube assembly 24 up the drill string 200 until the inner tube assembly 24 can be retrieved at a collar point located at an upper end of the drill string 200.

Once the inner tube assembly 24 has been retrieved and the core sample 10 removed from the core tube assembly 26, the valve system of the head assembly 100 can be reset so that the head assembly 100 can be used to deploy and retrieve the inner tube assembly 24 again. Resetting the valve system of the head assembly 100 may comprise levering the ball head 118 back through the bushing 120, or rotating the head portion 102 such that the head portion 102, and hence the ball head 118, gradually moves upwards until the ball head 118 has been pushed back through the bushing 120.

An alternative embodiment will now be described with reference to FIGS. 9 and 10.

In this embodiment, there is provided a valve and spearhead assembly 300. The valve and spearhead assembly 300 is arranged to replace the spearhead of a conventional head assembly. Conveniently, the valve and spearhead assembly 300 can be provided as a separate assembly for coupling to a conventional head assembly, such as an OEM head assembly. That is, the valve and spearhead assembly 300 is a component of a head assembly, the head assembly being couplable to a core tube assembly.

The valve and spearhead assembly 300 comprises a spearhead assembly that is couplable to an overshot (if required), and a valve system to facilitate deploying the head assembly down a drill string and retrieving the head assembly from down the drill string.

The valve and spearhead assembly 300 does not include the lower retracting case 122 or latch assembly 124 of the head assembly 100. Instead, the valve and spearhead assembly 300 is arranged to couple to a head assembly that comprises a latching arrangement having components such as the lower retaining case 122 and latch assembly 124. The valve and spearhead assembly 300 functions in a similar way to the head assembly 100 in respect of valve operation.

Figure 3:
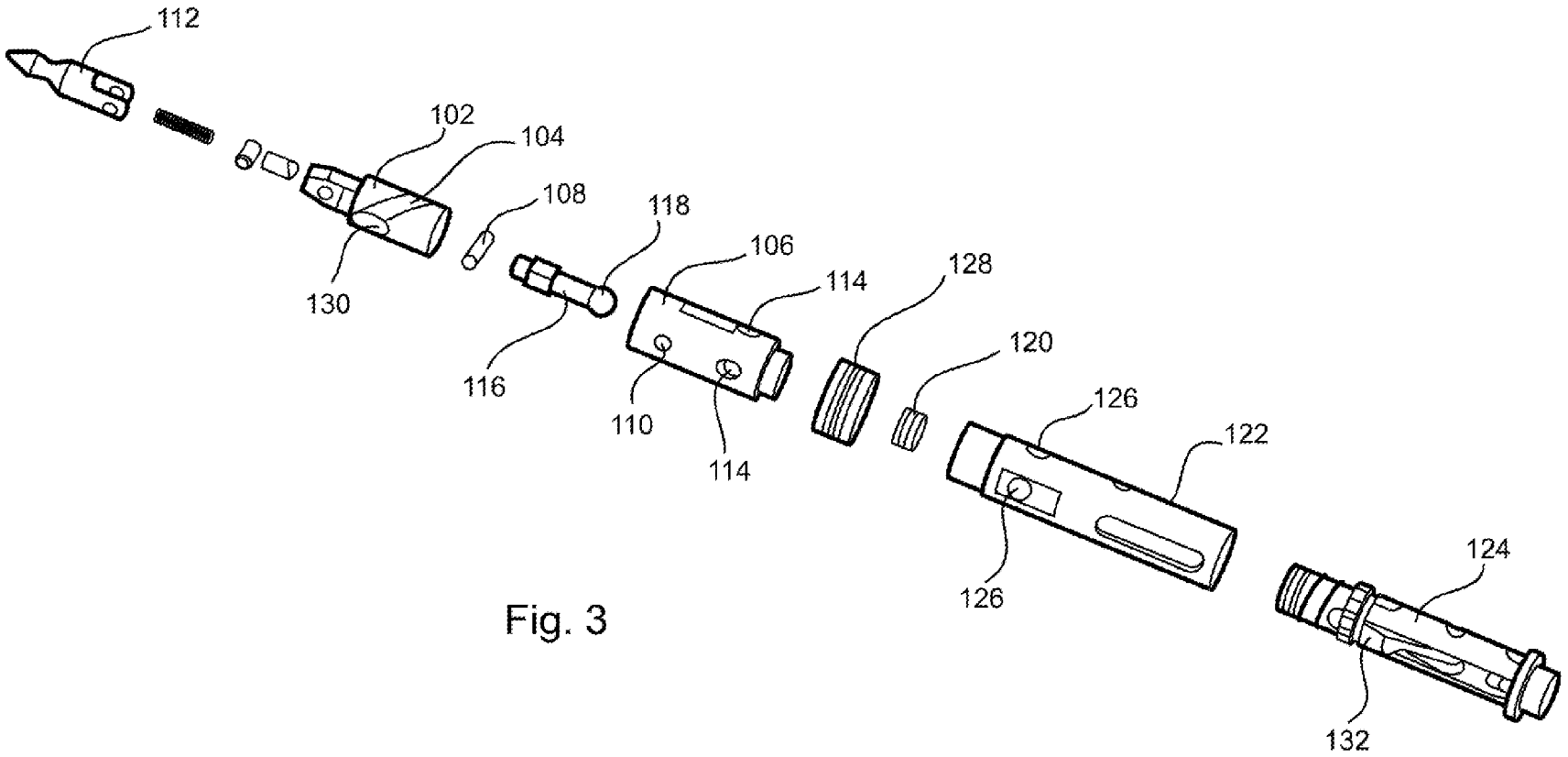
FIG. 3 is an exploded view of the head assembly of FIG. 2.
Figure 4:
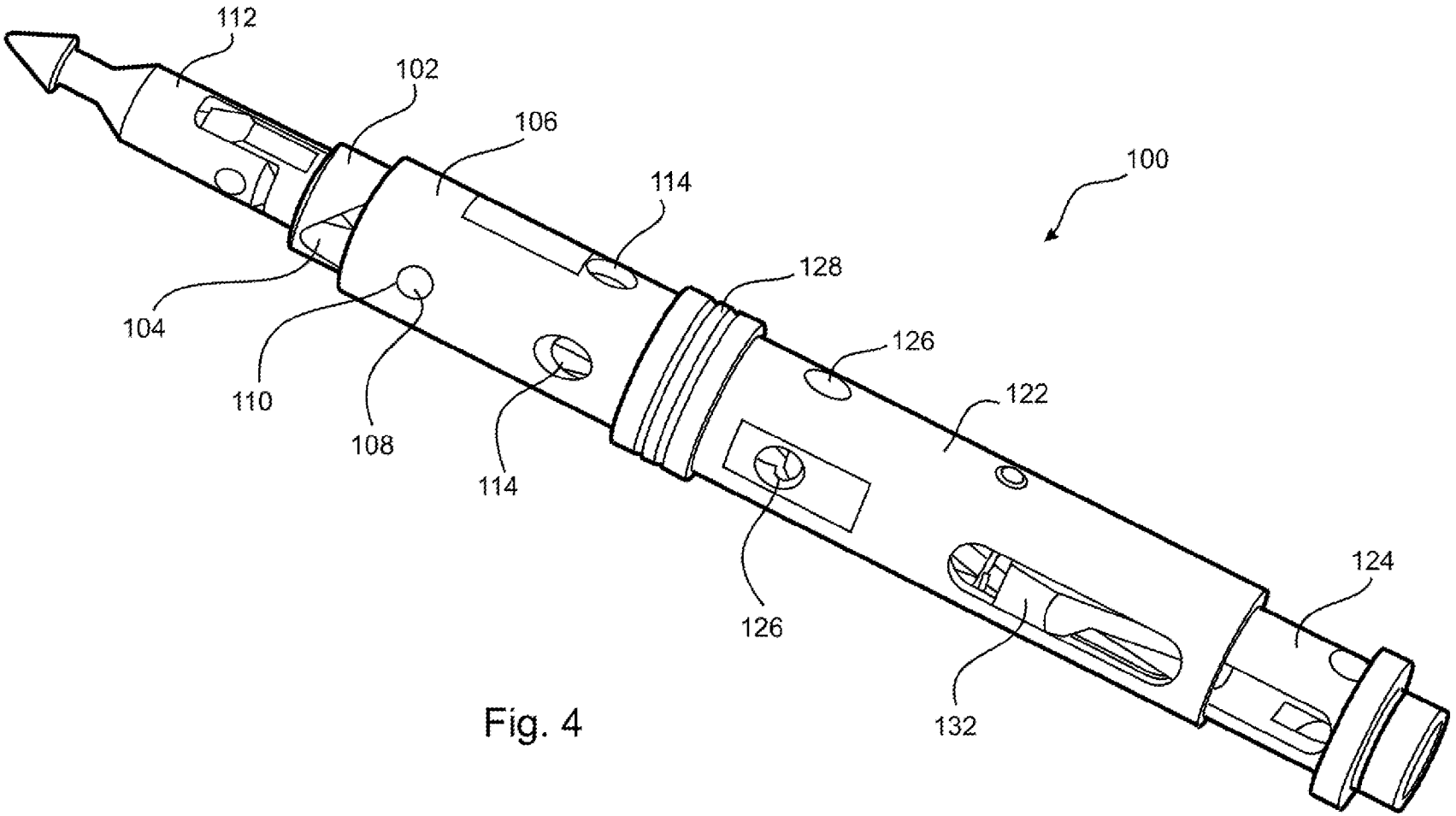
FIG. 4 is an isometric view of the head assembly of FIG. 2.
Figure 5:
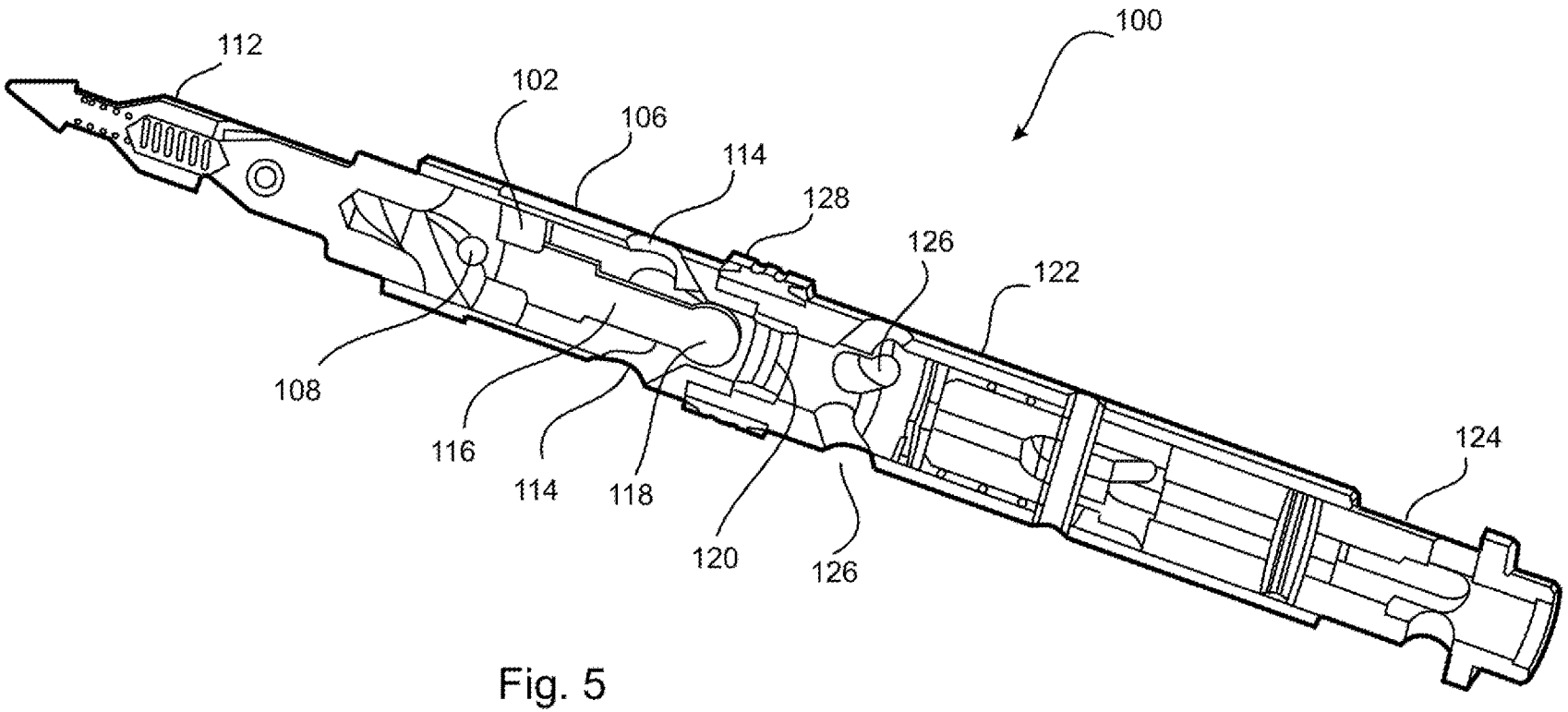
FIG. 5 is a cut away isometric view of the head assembly of FIG. 2.
Figure 6:
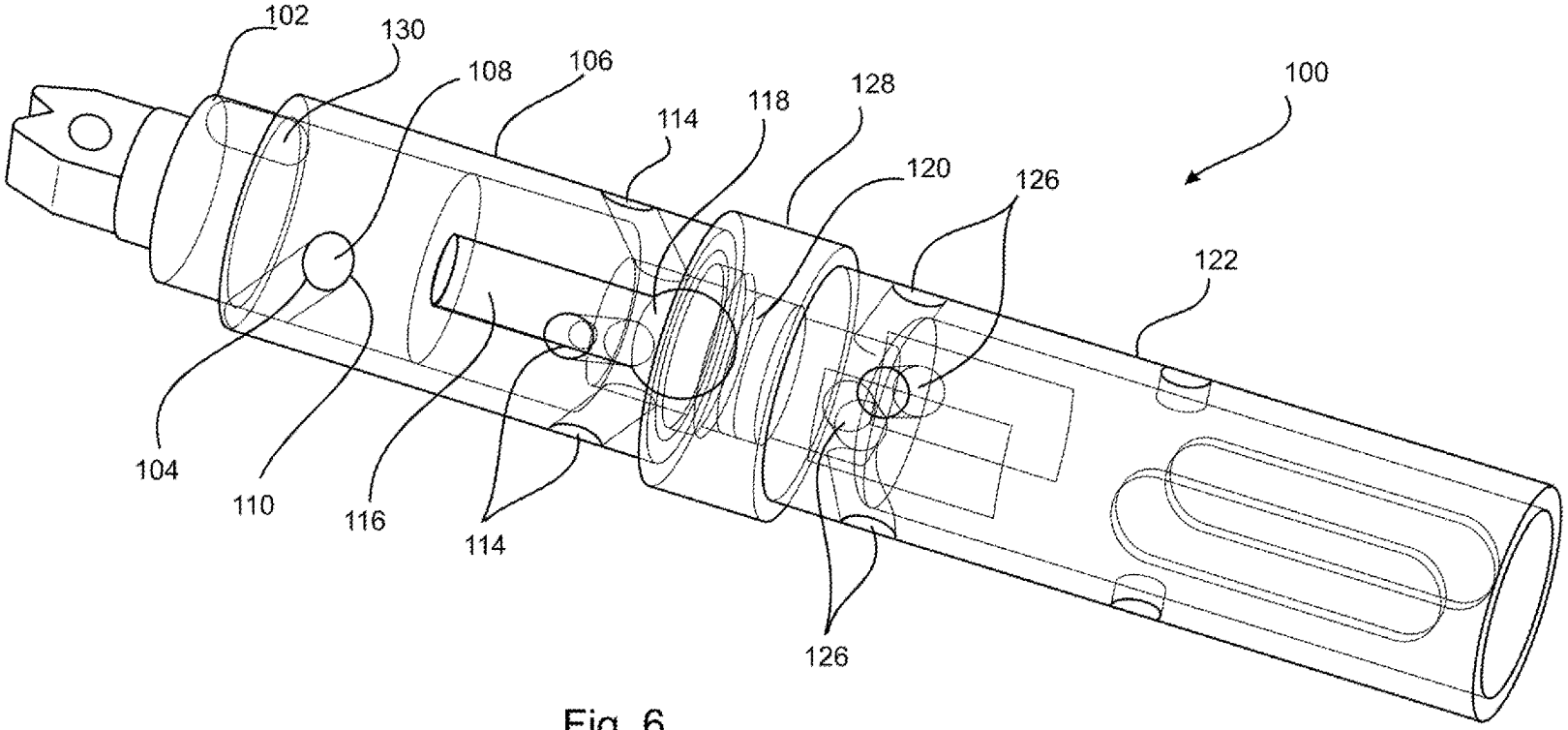
FIG. 6 is a partially transparent view of a portion of the head assembly of FIG. 2.
Figure 9:
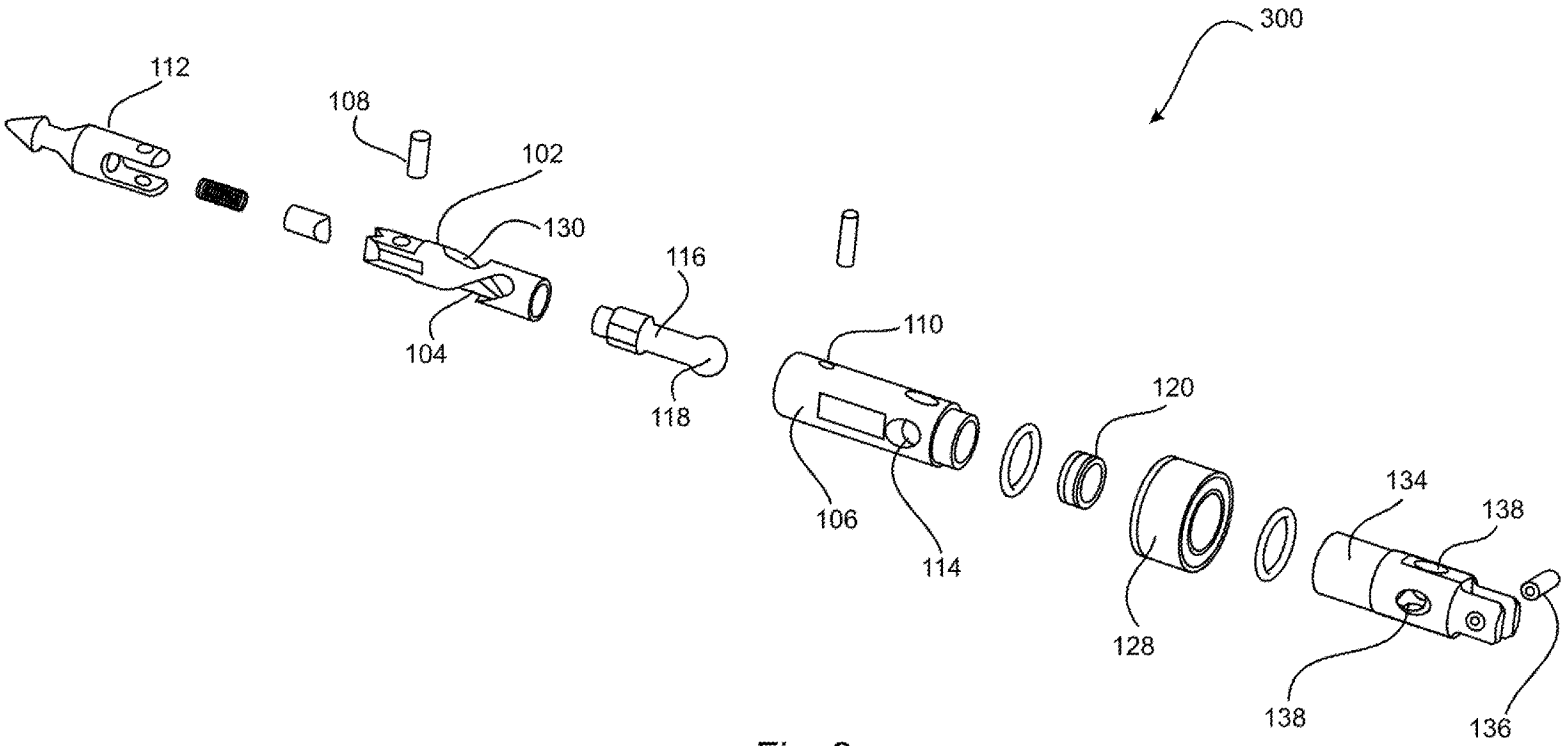
FIG. 9 is an exploded view of a head assembly in accordance with an embodiment of the present invention.
Figure 10:
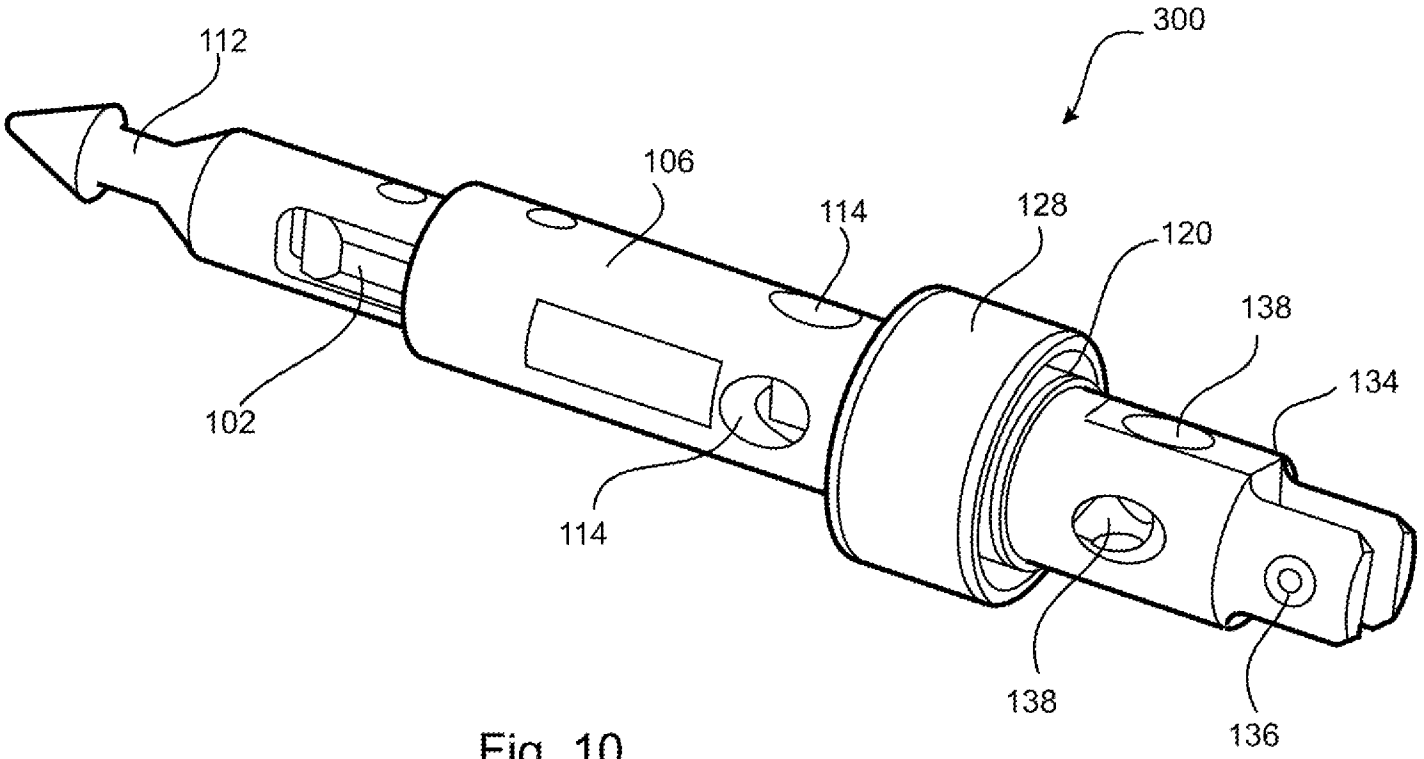
FIG. 10 is an isometric view of the head assembly of FIG. 10.

Comparing FIGS. 3 and 9, it can be seen that the valve and spearhead assembly 300 comprises some components that are common to the head assembly 100. However, instead of a lower retracting case 122 and latch assembly 124, the valve and spearhead assembly 300 comprises a coupling member 134 that is arranged to couple to a separate head assembly. The coupling member 134 comprises a pin 136 for coupling the valve and spearhead assembly 300 to the separate head assembly.

The valve and spearhead assembly 300 also comprises lower valve apertures 138 which are components of the valve system of the valve and spearhead assembly 300 and perform a similar function to the lower valve apertures 126 of the head assembly 100.

The seal 128 of the valve and spearhead assembly 300 is arranged around the coupling between the upper retracting case 106 and the coupling member 134 so as to provide a seal for preventing fluid flowing around the outside of the valve and spearhead assembly 300. The seal 128 is particularly located between the upper and lower valve apertures 114, 138 so as to assist in directing fluid flow through the valve apertures 114, 138.

It will be appreciated that the present arrangement enables a core drilling process to occur in a more efficient and less cumbersome way than known hitherto wherein manual retrieval of a core sample using an overshot is necessary. In particular, since the present arrangement requires less manual handling than conventional core retrieval methods, safety is enhanced.

Numerous variations and modifications will suggest themselves to persons skilled in the relevant art, in addition to those already described, without departing from the basic inventive concepts. All such variations and modifications are to be considered within the scope of the present invention, the nature of which is to be determined from the foregoing description.

For example, it will be appreciated that the valve system can be implemented in any appropriate way, including changing a location of the valve system or the manner of operation of any component of the valve system. For such alternative embodiments, the valve system can be part of, or otherwise couplable to, the inner core assembly 24, and the valve system can generally be arranged to move to a first closed configuration when fluid is pumped down the interior region A of the drill string 200 to facilitate deploying the inner tube assembly 24 down the drill string 200. The valve system is also generally arranged to move to an open configuration in response to the inner tube assembly 24 seating with the outer tube assembly 18 to allow the fluid to flow to the drill bit 14, and to move to a second closed configuration when fluid is pumped up the interior region A of the drill string 200 to facilitate retrieving the inner tube assembly 24 from down the drill string 200. It will be appreciated that the first and the second closed configurations may be the same, or they may be different.

In the description of the invention, except where the context requires otherwise due to express language or necessary implication, the words "comprise" or variations such as "comprises" or "comprising" are used in an inclusive sense, i.e. to specify the presence of the stated features, but not to preclude the presence or addition of further features in various embodiments of the invention.

The invention claimed is:

1. A valve system for an inner tube assembly arranged to be used in a drilling system to retrieve a core sample created by the drilling system, the inner tube assembly being insertable into a drill string of the drilling system at a first end of the drill string, the valve system being configurable in a first closed configuration, an open configuration, and a second closed configuration, wherein:

the valve system moves to the first closed configuration when fluid is pumped along an interior region of the drill string in a direction from the first end of the drill string towards the inner tube assembly, the valve system being arranged such that, when in the first closed configuration, a pressure of the fluid increases to facilitate deploying the inner tube assembly towards a second end of the drill string;

the valve system moves to the open configuration in response to the inner tube assembly reaching a vicinity of the second end of the drill string and being prevented from moving further towards the second end of the drill string, the valve system being arranged such that, when in the open configuration, fluid can flow to a drill bit located at or near the second end of the drill string; and the valve system moves to the second closed configuration when fluid is pumped along the interior region of the drill string towards the inner tube assembly in a direction from the second end of the drill string to the inner tube assembly, the valve system being arranged such that, when in the second closed configuration, the pressure of the fluid increases to cause the inner tube assembly to move away from the second end of the drill string and towards the first end of the drill string;

the valve system comprising:

a valve member and a valve seat with which the valve member can form a seal, the valve member being urged to move towards the valve seat when fluid flows along the interior region of the drill string towards the inner tube assembly in a direction from the first end of the drill string to the inner tube assembly, and the valve system being disposed in the first closed configuration when the valve member contacts and forms a seal with the valve seat;

wherein the valve member and the valve seat are arranged such that the valve member is movable through the valve seat in response to sufficient fluid pressure so as to dispose the valve system in the open configuration.

2. The valve system of claim 1, wherein the seal formed between the valve member and the valve seat when the valve system is in the first closed configuration is such that sufficient fluid pressure can build behind the valve system to deploy the inner tube assembly towards the second end of the drill string.

3. The valve system of claim 1, wherein the fluid pressure that is sufficient to move the valve system into the open configuration occurs when the inner tube assembly seats with an outer tube assembly of the drilling system and the inner tube assembly is unable to move further towards the second end of the drill string.

4. The valve system of claim 1, wherein, when the valve system is in the open configuration and fluid flows along the interior region of the drill string towards the inner tube assembly in a direction from the second end of the drill string to the inner tube assembly, the valve member is urged to move towards the valve seat and thereby the valve system is urged to move to the second closed configuration wherein the valve member forms a seal with the valve seat.

5. The valve system of claim 4, wherein the seal formed between the valve member and the valve seat when the valve system is in the second closed configuration is such that sufficient fluid pressure can build behind the valve system to cause the inner tube assembly to move away from the second end of the drill string and towards the first end of the drill string, and/or to disengage the inner tube assembly from the drill string.

6. The valve system of 1, wherein the valve system is arranged such that the valve member is prevented from moving through the valve seat when the valve system is in the second closed configuration and when fluid is flowing along the interior region of the drill string in a direction from the second end of the drill string towards the inner tube assembly.

7. The valve system of claim 6, wherein the valve system comprises a head portion to which the valve member is coupled, the head portion being retainable in a position such that the valve member is prevented from moving through the valve seat when the valve system is in the second closed configuration and when fluid is flowing along the interior region of the drill string in a direction from the second end of the drill string towards the inner tube assembly.

8. The valve system of claim 7, further comprising a stop, the valve system being arranged such that the head portion can move relative to the stop, the head portion comprising a recess that is arranged to engage with the stop when the valve system moves to the second closed configuration so as to retain the head portion, thereby preventing the valve member from being pushed through the valve seat.

9. The valve system of claim 8, wherein the head portion comprises a helical groove that is arranged to receive a portion of the stop such that the head portion rotates and moves in a direction towards the second end of the drill string relative to the stop as the valve system moves to the first closed configuration, the recess being connected to the helical groove and being arranged such that the portion of the stop is received in the recess when the valve system moves from the open configuration to the second closed configuration.

10. The valve system of claim 1, wherein the valve member has a substantially circular cross section, and wherein the valve seat has a correspondingly shaped cross section.

11. The valve system of claim 1, wherein the valve member is at least partially spherical shaped.

12. The valve system of 1, further comprising at least one upper and at least one lower valve aperture for directing fluid flow to the valve member.

13. The valve system of claim 12, wherein at least one of the upper or lower valve apertures is arranged so as to direct fluid flowing therethrough directly onto the valve member.

14. The valve system of claim 12, further comprising a seal that is arranged on an exterior surface of the inner tube assembly at a location between the upper and lower valve apertures, the seal being arranged to form a seal between the exterior surface of the inner tube assembly and an interior surface of the drill string so as to prevent fluid flowing around the exterior of the inner tube assembly between regions in the vicinity of the upper and lower apertures.

15. A head assembly for deploying a core tube assembly in a drill string and for retrieving the core tube assembly from the drill string, the head assembly being arranged to be couplable to the core tube assembly to form an inner tube assembly, the head assembly comprising a valve system in accordance with claim 1.

16. A method of deploying an inner tube assembly in a drill string of a drilling system, and of retrieving the inner tube assembly from the drill string, the inner tube assembly being insertable into the drill string at a first end of the drill string, the inner tube assembly comprising a valve system that is configurable in a first closed configuration, an open configuration, and a second closed configuration, the method comprising the steps of:

pumping fluid through an interior region of the drill string, towards the inner tube assembly disposed in the drill string in a direction from the first end of the drill string towards the inner tube assembly;

moving the valve system to the first closed configuration to facilitate deploying the inner tube assembly towards a second end of the drill string in response to the fluid flowing along the interior region of the drill string in a direction from the first end of the drill string towards the inner tube assembly;

moving the valve system to the open configuration in response to the inner tube assembly reaching a vicinity of the second end of the drill string and being prevented from moving further towards the second end of the drill string, the valve system being arranged such that, when in the open configuration, fluid can flow to a drill bit located at or near the second end of the drill string;

pumping fluid along the interior region of the drill string towards the inner tube assembly in a direction from the second end of the drill string towards the inner tube assembly; and moving the valve system to the second closed configuration to facilitate retrieving the head assembly from the vicinity of the second end of the drill string in response to the fluid flowing along the interior region of the drill string towards the inner tube assembly in a direction from the second end of the drill string to the inner tube assembly;

the valve system comprising a valve member and a valve seat with which the valve member can form a seal, and the step of moving the valve system to the first closed configuration comprises urging the valve member to move towards the valve seat to form a seal with the valve seat in response to the step of pumping fluid through the interior region of the drill string in a direction from the first end of the drill string towards the inner tube assembly; and wherein the step of moving the valve system to the open configuration comprises moving the valve member through the valve seat in response to sufficient fluid pressure acting on the valve member.

17. The method of claim 16, wherein the step of moving the valve system to the first closed configuration causes a seal to form between the valve member and the valve seat such that sufficient fluid pressure can build behind the valve member to cause movement of the inner tube assembly towards the second end of the drill string.

18. The method of claim 16 wherein the step of moving the valve system to the second closed configuration comprises urging the valve member to move towards the valve seat to form a seal with the valve seat in response to the step of pumping fluid through the interior region of the drill string towards the inner tube assembly.

19. The method of claim 18, wherein the step of moving the valve system to the second closed configuration causes a seal to form between the valve member and the valve seat such that sufficient fluid pressure can build behind the valve member to cause the inner tube assembly to move away from the vicinity of the second end of the drill string towards the first end of the drill string, and/or to disengage the inner tube assembly from the drill string.

* * * * *